United States Patent [19]
Jayant et al.
[11] 4,100,374
[45] Jul. 11, 1978

[54] UNIFORM PERMUTATION PRIVACY SYSTEM

[75] Inventors: Nuggehally Sampath Jayant, Summit, N.J.; Subhash Chandra Kak, New Delhi, India

[73] Assignee: Bell Telephone Laboratories, Incorporated, Murray Hill, N.J.

[21] Appl. No.: 786,129

[22] Filed: Apr. 11, 1977

[51] Int. Cl.[2] ..... H04K 1/06
[52] U.S. Cl. ..... 179/1.5 S; 179/1.5 R; 178/22
[58] Field of Search ..... 179/1.5 R, 1.5 S; 178/22

[56] References Cited

U.S. PATENT DOCUMENTS

| | | | |
|---|---|---|---|
| 2,045,624 | 6/1936 | Walker | 179/1.5 R |
| 2,312,897 | 3/1943 | Guanella et al. | 179/1.5 R |
| 2,401,888 | 6/1946 | Smith | 179/1.5 R |
| 2,531,435 | 11/1950 | Hoth | 179/1.5 R |
| 2,913,525 | 11/1959 | Larsen | 179/1.5 R |
| 3,731,197 | 5/1973 | Clark | 178/22 |
| 3,773,977 | 11/1973 | Guanella | 179/1.5 R |
| 3,824,467 | 7/1974 | French | 178/22 |
| 3,921,151 | 11/1975 | Guanella | 178/22 |
| 3,962,539 | 6/1976 | Ehrsom et al. | 178/22 |
| 3,970,790 | 7/1976 | Guanella | 179/1.5 R |

*Primary Examiner*—Howard A. Birmiel
*Attorney, Agent, or Firm*—Jack S. Cubert

[57] ABSTRACT

A privacy communication arrangement temporally rearranges an intelligence signal to produce an uncorrelated scrambled signal. The intelligence signal is sampled at a predetermined rate and the samples are divided into groups of N successive samples. Each N successive sample group is uniformly permuted by transposing the $i^{th}$ sample ($i = 1, 2, \ldots, N$) to the $K_1\, i^{th}$ (modulo N) sample position, where $K_1$ is an integer prime with respect to N. The uniformly permuted group is transformed into the N successive sample group by transposing the $j^{th}$ sample of the permuted group to the $K_2\, j^{th}$ (modulo N) sample position.

16 Claims, 5 Drawing Figures

UNIFORM PERMUTATION PRIVACY SYSTEM

BACKGROUND OF THE INVENTION

Our invention relates to privacy arrangements in communication systems and, more particularly, to privacy systems adapted to encrypt a signal by reordering time segments of the signal.

In telephone and other types of communication systems, it is often necessary to render a signal being transmitted unintelligible to assure privacy. Such secret communication systems have generally been restricted to selected communication channels over which secret messages are expected to be sent. Privacy is also desirable where messages of a nonconfidential nature are transmitted over a common communication path that is easily accessible to third parties. Thus, privacy arrangements are applicable to radio communication systems such as mobile telephone where interception is readily accomplished, and also to wire communication systems such as those utilizing time division switching where connections to a common time division bus system may result in interception of a speech signal by means of crosstalk between time channels or otherwise.

One known privacy method is operative to divide a speech or other intelligence signal from a source into successive time segments. The segments are rearranged to render the signal unintelligible, and the time-scrambled signal is transmitted. An inverse rearrangement of the scrambled signal at the destination point reconstructs the original intelligence signal. Signal segment rearrangement in a predetermined repetitive order may, of course, be understood or readily decrypted by a third party having access to the communication path since the encrypted signal is closely correlated with the original intelligence signal. Consequently, signal element rearrangement has been accomplished by pseudo-random schemes or by schemes involving a complex, nonuniform permutation of signal segments. Such schemes result in an encrypted signal which is uncorrelated with the original intelligence signal. While such pseudo-random or nonuniform permutation schemes are widely used, the apparatus for implementing these schemes and the keys used to encipher and decipher the permutated signal are relatively complex, owing to the long-term nonrepeatability of the permutations to produce the uncorrelated scrambled signal. Where, however, privacy devices are attached to each terminal of a large communication system, such as in mobile telephone or a time division PBX, the complexity of the pseudo-random or nonuniform permutation encrypting, decrypting, and keying apparatus renders the privacy feature uneconomical. Thus, in order to provide privacy to all subscribers served by a large communication system, it is advantageous to utilize a relatively simple uniform permutation arrangement that retains the described encryption characteristics.

It is an object of the invention to provide an improved privacy system which avoids complicated scrambling arrangements.

SUMMARY OF THE INVENTION

Our invention is directed to a privacy communication arrangement in which an intelligence signal is partitioned into successive elements, and successive groups of N signal elements are formed. Each N element group is uniformly permuted by transposing the $i^{th}$ position element ($i = 1,2,\ldots,N$) to the $K_1 i^{th}$ (modulo N) position, where $K_1$ is an integer prime with respect to N. The original N element group is reconstructed from the uniformly permuted group by transposing the $j^{th}$ position ($j = 1,2,\ldots,N$) element of the permuted group to the $K_2 j^{th}$ (modulo N) position, where $K_1K_2 = 1$ (modulo N).

According to one aspect of the invention, the intelligence signal is successively sampled at a predetermined rate and the signal samples are partitioned into successive groups each having N successive samples. Each N successive sample group is uniformly permuted by transposing the $i^{th}$ position ($i = 1,2,\ldots,N$) sample to the $K_1 i^{th}$ (modulo N) position, where $K_1$ is an integer prime with respect to N. The uniformly permuted groups are successively transmitted and the original N successive sample group is reconstructed by transposing the $j^{th}$ position ($j = 1,2,\ldots,N$) sample of the permuted group to the $K_2 j^{th}$ (modulo N) position, where $K_2K_1 = 1$ (modulo N).

According to another aspect of the invention, the signal samples are digitally encoded, and the code bits are partitioned into successive groups, each group having N successive bits. Each N successive bit group is uniformly permuted by transposing the $i^{th}$ position bit ($i = 1,2,\ldots,N$) bit to the $K_1 i^{th}$ (modulo N) position, where $K_1$ is an integer prime with respect to N. The uniformly permuted N bit groups are successively transmitted over a common communication path, and the original N successive bit group is reconstructed by transposing the $j^{th}$ position ($j = 1,2,\ldots,N$) bit of the uniformly permuted N bit group to the $K_2 j^{th}$ (modulo N) position, where $K_2K_1 = 1$ (modulo N).

According to yet another aspect of the invention, the N successive samples or bits are transposed by insertion into a store in successive order ($i = 1,2,\ldots,N$) and retrieved from the store in $K_1 i^{th}$ (modulo N) sequence. In reconstructing the N successive group from the permuted group, the permuted group is stored in order ($j = 1,2,\ldots,N$) and the group is retrieved in $K_2 j^{th}$ (modulo N) sequence.

According to yet another aspect of the invention, the N successive sample or bit group is transposed by insertion of the $i^{th}$ sample or bit into the $K_1 i^{th}$ (modulo N) position of a store and retrieving them in sequential order ($i = 1,2,\ldots,N$). In reconstructing the N successive group from the permuted group, the $j^{th}$ sample or bit is stored in the $K_2 j^{th}$ (modulo N) position of the store and the group is retrieved in sequential order ($j = 1,2,\ldots,N$).

In one embodiment illustrative of the invention, a speech signal is sampled at a predetermined rate corresponding to twice its bandwidth, and groups of N successive signal samples are serially inserted in a store in successive order. The output of a counter operating at the sampling rate is multiplied by a constant $K_1$ coded signal, where $K_1$ is an integer prime with respect to N. The product code from the multiplier addresses the successive sample store so that the $i^{th}$ position sample in the store is placed in the $K_1 i^{th}$ (modulo N) position of the scrambled output sequence from the store. The scrambled output groups are transmitted over a communication path.

Upon receipt, the scrambled group of N samples is stored. The output of a counter, operative at the sampling rate, is multiplied by a constant $K_2$ coded signal, where $K_2K_1 = 1$ (modulo N). The resulting product code addresses the scrambled code store. In this manner, the $j^{th}$ position sample of the scrambled code in the store is transposed to the $K_2 j^{th}$ (modulo N) position of the output sequence therefrom and the output sequence is a replica of the successive sample sequence.

In another embodiment illustrative of the invention, the speech signal samples are digitally encoded and groups of N successive code bits are stored. The stored N successive bits of each group are addressed by a code corresponding to the product of the output of a counter operative at the code bit rate and the $K_1$ key code, whereby the $i^{th}$ position bit of the N code bits is transposed to the $K_1 i^{th}$ (modulo N) bit position in the output sequence. In this manner, a scrambled bit group is generated. The scrambled bits of each group are stored after receipt at a destination and the store is addressed by a code corresponding to the product of a counter output operative at the bit rate and a constant $K_2$ key code. Responsive to the address code, the $j^{th}$ bit position of the scrambled code appears in the $K_2 j^{th}$ (modulo N) position of the sequence from the addressed store. The rearranged outputs of the addressed store, a replica of the original N bit code group, are decoded and filtered to reconstruct the speech signal.

DETAILED DESCRIPTION

Figure 1:
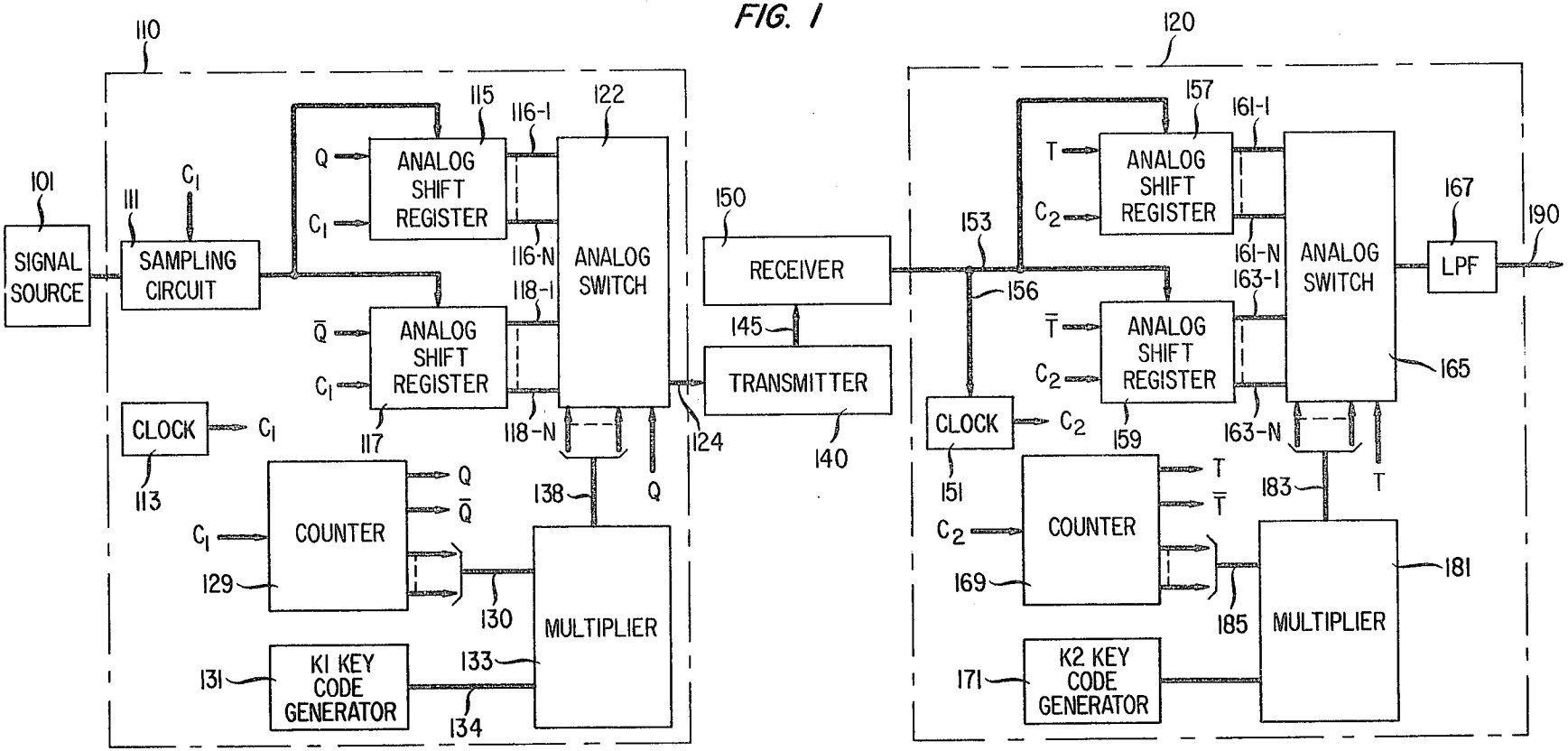
FIG. 1 depicts a block diagram of a privacy communication arrangement illustrative of the invention.

FIG. 1 shows a privacy-type communication arrangement in which a speech signal generated in signal source 101 is scrambled by encrypter 110 to provide privacy. The scrambled output of encrypter circuit 110 is conditioned for transmission in transmitter 140 and transmitted over communication path 145. At the destination, the scrambled signal is applied to decrypting circuit 120 via receiver 150. The output of decrypter circuit 120 on line 190 is a replica of the speech signal from signal source 101.

Figure 4:
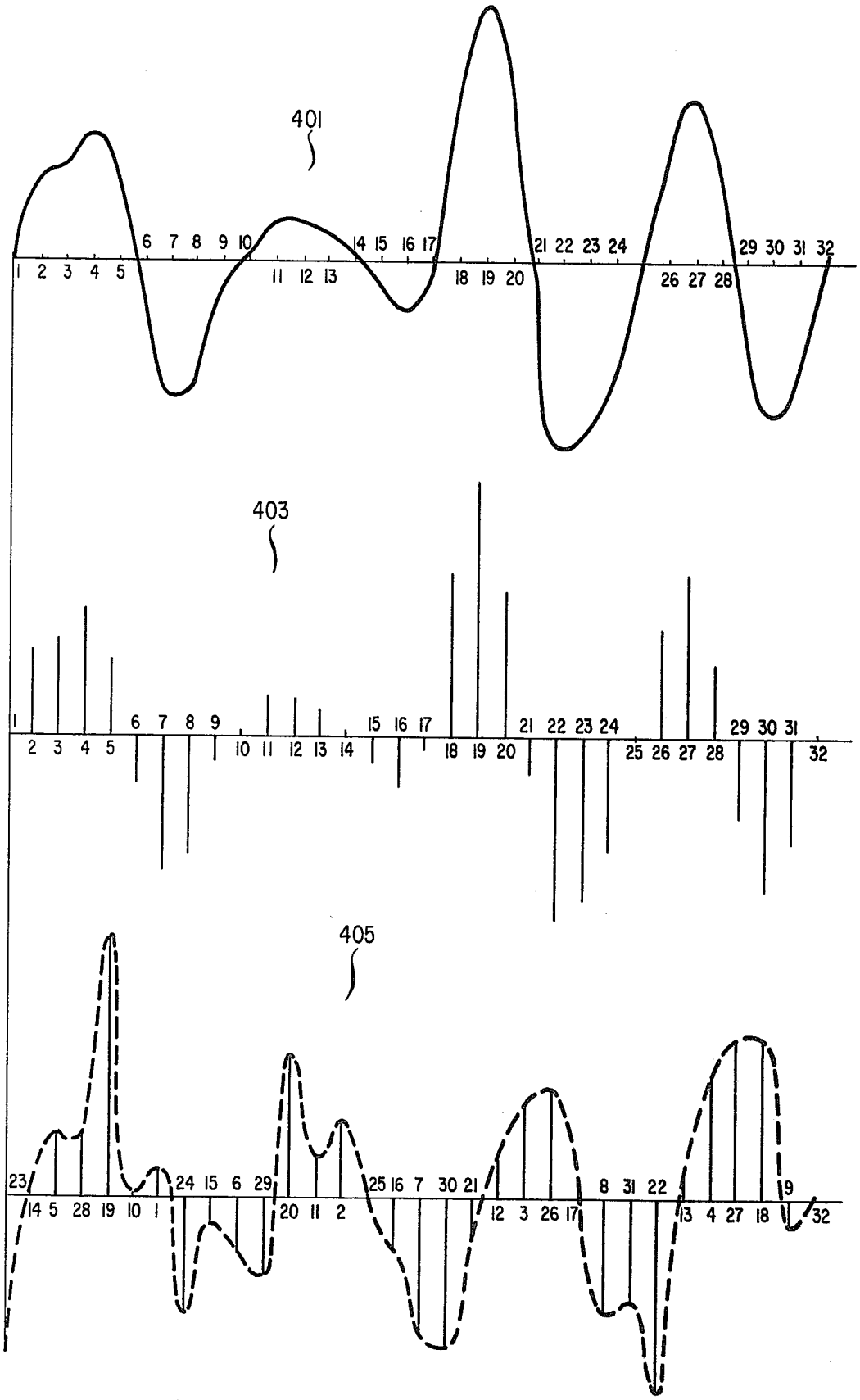
FIG. 4 shows waveforms useful in illustrating the operation of the privacy arrangement shown in FIG. 1.

Waveform 401 in FIG. 4 shows a portion of a speech signal applied from signal source 101 to encrypting circuit 110. The speech signal waveform is applied to sampling circuit 111 which, as is well known in the art, is operative to provide successive samples of the speech signal at a predetermined rate. Clock 113 supplies clock signal C1 to sampling circuit 111 so that the successive samples of speech signal waveform 401 are obtained as shown in waveform 403.

The output of sampling circuit 111 is connected to the input of analog shift register 115 and also to the input of analog shift register 117. These analog shift registers may be of the type described in "The 'bucket-brigade delay line', a shift register for analogue signals," by F. L. J. Sangster, *Phillips Technical Review*, Vol. 31, 1970, No. 4, pages 97–110. Counter 129 is an $n+1$ stage counter operative responsive to clock signal C1 from clock 113 to provide a coded output corresponding to the first $n$ stages of the counter and complementary signals Q and $\overline{Q}$ corresponding to the last counter stage. Thus, for the first N counts of the clock pulses, signal $\overline{Q}$ is enabling and signal Q is inhibiting. Responsive to counter signal $\overline{Q}$ and clock pulses C1, the signal samples from sampling circuit 111 are serially inserted into analog shift register 117. At this time, signal Q from counter 129 inhibits shift register 115 so that the previous N sample outputs from sampling circuit 111 are temporarily stored therein.

Assume, for purposes of illustration, that analog shift register 115 is adapted to temporarily store 32 successive samples of waveform 403. Each of the stages of shift register 115 is connected to an input of analog switch 122, and analog switch 122 is operative responsive to each clock pulse to selectively transfer one of the 32 samples from register 115 to line 124. Analog switch 122 is addressed by the output of multiplier 133, which multiplier is responsive to the output of stages 1 through $n=5$ of counter 129 and the output of code generator 131. Code generator 131 repeatedly applies a constant $K_1$ code to one input of multiplier 133. $K_1$ is a selected integer which is prime with respect to N. Where N is 32, $K_1$ may be 23. It is to be understood that other integers may be selected for use in encrypter 110.

For N = 32 and $K_1$ = 23, counter 129 is a six-stage binary counter, and the binary coded output of $K_1$ generator 131 is 23 (10111). At the beginning of the sampling group, counter 129 is set to 000001. Responsive to this stage, analog shift register 115 is inhibited from receiving samples by signal Q, and analog shift register 117 is enabled to receive successive samples from sampling circuit 111. The outputs of the first five stages of counter 129 are applied to one input of multiplier 133 via line 130, and the 10111 code from generator 131 is applied to the other input of multiplier 133 via line 134. When counter 129 is in its first state, the output of multiplier 133 is 10111, since only the five least-significant bits of the product code are used to address the 32 inputs to analog switch 122 from analog shift register 115. The Q output of counter 129 is applied to analog switch 122 to select the outputs of register 115.

Responsive to the address code 23, analog switch 122 connects the twenty-third sample position in analog shift register 115 to line 124. In this manner, the twenty-third sample in the 32 successive sample group temporarily stored in register 115 is transposed to the first position of the scrambled group appearing on line 124. This is illustrated in waveform 405, which shows the twenty-third sample of successive sample waveform 403 in the first sequential sample position of the scrambled waveform 405.

Upon the occurrence of the next C1 clock pulse, counter 129 is incremented to its second state so that the output of the multiplier is 14 (01110), which is $23 \times 2$ (modulo 32). Analog switch 122 is now operative to transfer the fourteenth sample from analog shift register 115 to line 124, as indicated in scrambled sample waveform 405. Counter 129 is successively incremented by clock pulse C1, and, responsive thereto, the $K_1 i^{th}$ (modulo 32) position sample in register 115 is supplied to line 124 via analog switch 122. Thus, the fifth sample of register 115 is transposed to the third position in the sequence on line 124 and, in like manner, the 28th sample of register 115 is transferred to the fourth position in the scrambled sequence on line 124. The arrangement of the scrambled samples on line 124 is shown in waveform 405. Advantageously, encrypter 110 is operative to uniformly permute the successive samples of each group in a simple fashion. But the permutation is made modulo N. Consequently, the resultant scrambled sample group is uncorrelated with the input signal waveforms so that privacy is achieved.

The scrambled sample sequence on line 124 is applied to transmitter 140 wherein it is conditioned for transmittal to a selected destination point via communication path 145. Where, for example, a radio arrangement is used, such as in mobile telephone, transmitter 140 is operative to convert the scrambled group to appropriate electromagnetic signals. Transmitter 140 may be arranged to transmit the samples directly or may include a low-pass filter so that an analog signal corresponding to the scrambled group sample sequence is transmitted. Such a low-pass filter must pass all frequency components of the scrambled waveform up to one-half the sampling frequency without attenuation. Where a wire communication path is used, such as in time-division switching, transmitter 140 is adapted to appropriately shape and apply the scrambled samples to a common bus system.

Receiver 150 is responsive to the received scrambled group signals from transmitter 140 to form a scrambled group sequence of samples which are applied to decrypter circuit 120. In decrypter circuit 120, the scrambled sample group is applied to analog shift registers 157 and 159. It is also applied, via line 156, to clock 151 to synchronize clock 151 with clock 113 in encrypter circuit 110. It is to be understood that other synchronizing arrangements well known in the art may be used. Clock 151 is operative to provide clock pulses at the sampling rate.

Counter 169 is responsive to the C2 clock pulses from clock 151 to provide a set of coded signals to multiplier 181 and to provide a signal T to analog shift register 157 and to analog switch 165. Where each of the analog shift registers stores 32 bits, counter 129 is a six-stage counter. The outputs of the first five stages are applied to multiplier 181 via line 185. The T output of the sixth stage is applied to shift register 157, and the $\overline{T}$ output of the sixth stage is applied to analog shift register 159. The scrambled group samples are serially inserted into register 157 responsive to signal T being enabling. When signal $\overline{T}$ is enabling, only shift register 159 serially receives the scrambled group samples.

Assume for purposes of illustration that analog shift register 157 has just stored the thirty-second sample of the incoming scrambled group represented in waveform 405. Counter 169 is then reset to its 000001 state.

Signal $\overline{T}$ is enabling so that the next scrambled group of 32 samples is serially inserted into shift register 159 responsive to the C2 clock pulses. The stored 32 samples in shift register 157 are applied to analog switch 165 via lines 161-1 to 161-N. Analog switch 165 is addressed by the output of multiplier 181. The outputs of the first five stages of counter 169 are applied to one input of multiplier 181 via line 185, and the output of $K_2$ generator 171 is applied to the other input of multiplier 181. $K_2$ is selected in accordance with $K_2K_1 = 1$ (modulo N). Analog switch 165 is operative as addressed by the output of multiplier 181 to rearrange the 32 samples from shift register 157 so that the sampled waveform of waveform 403 is reproduced.

Since encrypter 110 transposed the $K_1$ $i^{th}$ sample of the 32 successive sample group into the $i^{th}$ position of the scrambled group, code generator 171 must produce a constant $K_2$ which is effective to provide an inverse transformation. Thus, the addressing of analog switch 165 must result in $K_2 j^{th}$ sample of the scrambled group from register 157 being transposed to the $j^{th}$ position of the successive sample group sequence obtained at the output of switch 165. The desired transformation is obtained by selecting $K_2$ as an integer in accordance with $K_2K_1 = 1$ (modulo N).

Where N is 32 and $K_1$ is 23, the required $K_2$ key is 7, and multiplier 181 is operative to form the product of the state of counter 169 and $K_2$ code. When counter 169 is in its 1 (000001) state, the product code applied to switch 165 via line 183 is 7 (00111). Responsive to this product code, switch 165 selectively connects the seventh sample position of register 157 to the input of low-pass filter 167. As shown in waveform 405, the seventh position of the scrambled group contains the first sample of the original successive group. Thus, the first sample is restored to its original position in the reformed successive group.

Responsive to the next C2 clock pulse, counter 169 is incremented to its 2 (00010) state, and the product code from multiplier 181 becomes 14 (01110). Responsive to this code, analog switch 165 connects the fourteenth position of shift register 157 to the input of low-pass filter 167. Since the fourteenth position of the scrambled waveform 405 is the second sample of the original successive sequence, sample 2 is transposed from the fourteenth position of waveform 405 to the second position of waveform 403. The addressing code from multiplier 181 is modulo 32. Thus, when counter 169 is incremented to its fifth (00101) state, the product code from multiplier 181 is 3 (00011), whereby the third position of scrambled waveform 405 is transposed to the fifth position in the sequence at the input of low-pass filter 167. Since the third position of waveform 405 is the fifth sample of the original sampled group, decrypter 120 is effective to transpose the original fifth sample from position 3 in the scrambled group into its proper position in the decrypted successive sample group.

At the end of the scrambled group count, waveform 405 has been transformed into a replica of waveform 403 so that low-pass filter 167 provides a replica of the original speech signal as shown in waveform 401. Counter 169 is then reset to its 100001 state. The next scrambled group of 32 samples from receiver 150 is serially inserted into register 157, while the 32 samples in register 159 are transposed.

In accordance with the invention, an input speech signal is uniformly permuted under control of a simple constant key $K_1$ to produce a time-scrambled signal. The key is relatively prime with respect to N, and the uniform permutation is made modulo N so that the scrambled signal is uncorrelated with the input signal. The scrambled signal is uniformly permuted at a destination through the use of a second key $K_2$ selected so that $K_2K_1 = 1$ (modulo N) to produce a replica of the input speech signal.

In the circuit of FIG. 1, clocks 113 and 151, counters 129 and 169, key code generators 131 and 171, and multipliers 133 and 181 may comprise 74000 series TTL logic circuits well known in the art and described in *The TTL Data Book for Design Engineers,* 2nd Edition, by Texas Instruments Inc., copyright 1976 by Texas Instruments Inc. Analog switches 122 and 165 may each comprise analog switch type LF1331, described in *Linear Data Book,* by National Semiconductor Corp., at pages 6–47.

Figure 2:
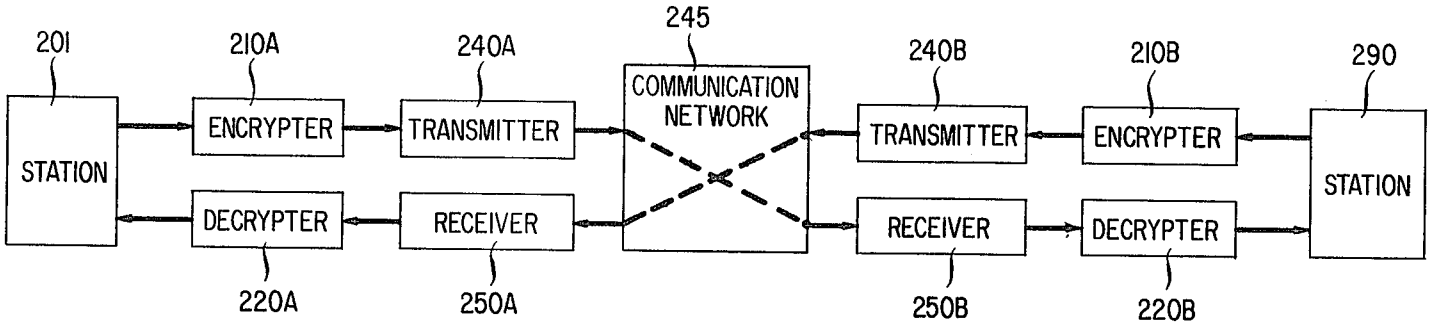
FIG. 2 depicts a general block diagram of a communication system in which the privacy arrangement of FIG. 1 is used.

FIG. 2 shows a communication arrangement between station 201 and station 290 utilizing the encryption and decryption described with respect to FIG. 1. In FIG. 2, an outgoing speech signal from station 201 is encrypted in encrypter 210A which may comprise encryption circuit 110 of FIG. 1. The scrambled signal from encrypter 210A is conditioned for transmission by transmitter 240A and is sent over communication network 345 to receiver 250B. Communication network 345 may comprise a mobile telephone network or a time-division switching arrangement. The scrambled signal from receiver 250B is decrypted in decrypter 220B, which may comprise decryption circuit 120 of FIG. 1, and the replica of the outgoing signal from station 201 is applied from decrypter 220B to station 290.

In like manner, the outgoing signal from station 290 is scrambled in encrypter 210B, which again may comprise encrypting circuit 110 of FIG. 1. The scrambled signal is transmitted by transmitter 240B to receiver 250A via communication network 345 and is decrypted in decrypter 220A, which may comprise decrypter circuit 120 of FIG. 1. The decrypted signal corresponding to the outgoing signal from station 290 is then applied to station 201. The modulo N uniform permutation scrambling arrangement of the invention allows the use of relatively simple encryption and decryption circuits so that all stations of a large communication system may be equipped with an economical privacy arrangement utilizing a simple key arrangement. In the circuit of FIG. 2, the keys $K_1$ and $K_2$ for a pair of interconnected stations may be selected by a common control in communication network 245 or may be selected in the calling station and transmitted to the called station.

Figure 3:
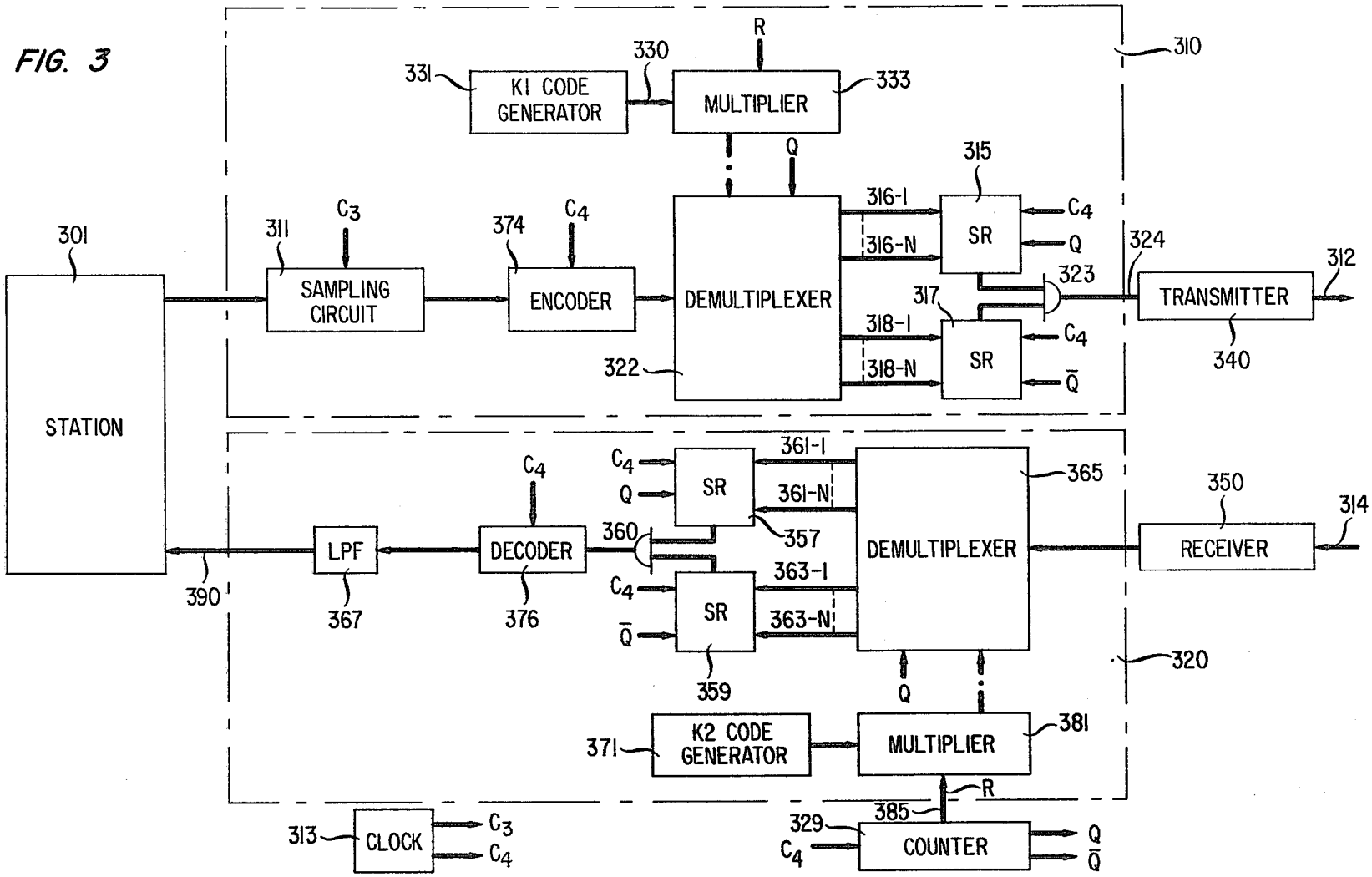
FIG. 3 depicts a block diagram of another privacy communication arrangement illustrative of the invention.

FIG. 3 shows another embodiment illustrative of the invention in which a speech signal is digitally encoded prior to scrambling and in which scrambled bit groups are transmitted over a common communication path. In FIG. 3 station 301 is connected to transmitter 340 via encryption circuit 310 and is connected to receiver 350 via decryption circuit 320. Clock 313 and counter 329 serve both the encryption and decryption circuits. The outgoing speech signal from station 301 is applied to sampling circuit 311, which produces successive samples of the outgoing speech signal at a sampling rate determined by clock signal C3. Each sample from sampling circuit 311 is digitally encoded in encoder 374 under control of code clock signal C4. Signals C4 occur at the code bit rate, which is higher than the sampling rate. Encoder 374 may comprise any of the encoder circuit arrangements well known in the art adapted to produce a digitally coded signal from received samples. Pulse code modulation, adaptive pulse code modulation, delta modulation, or any other digital code arrangement may be used. Such digital coding arrangements are described, for example, in "Waveform Quantization and Coding" edited by N. S. Jayant, IEEE Press, New York, 1976.

Figure 5:
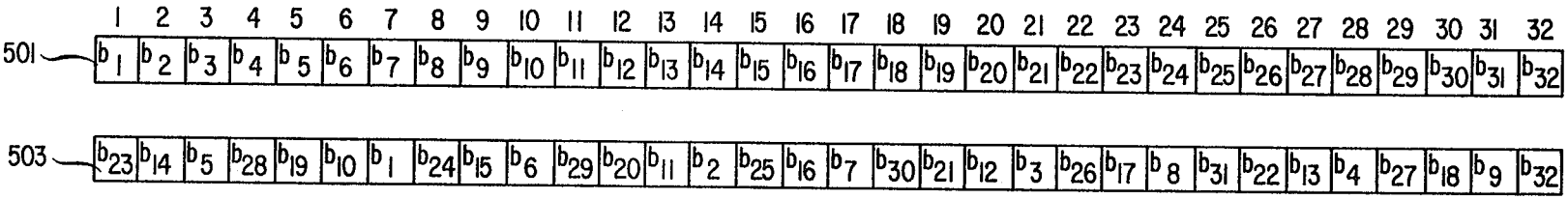
FIG. 5 shows the manner in which message signal elements are transposed in the privacy arrangement in FIG. 3.

Waveform 501 in FIG. 5 shows a group of 32 bits $b_1$ through $b_{32}$ in successive order. The bit group corresponds to a portion of the bit stream output of encoder 374 that may be obtained, for example, from the speech signal waveform shown in waveform 401. The bit group of waveform 501 is supplied to demultiplexer 322 which is operative to uniformly transpose the bit sequence and apply the transposed sequence to one of shift registers 315 and 317. For purposes of illustration, the $K_1$ key is selected as 7. This $K_1$ key is prime with respect to 32, the number of bits in each group. For a 32-bit group, counter 329 is a six-stage counter which is incremented responsive to code bit clock signal C4. Assuming that counter 329 has just reset to its 000001 state, the outputs of the first five stages of counter 129 are 00001 and these outputs form code R. The highest order stage of counter 329 provides outputs Q and $\overline{Q}$. $\overline{Q}$ is in its enabling state. The successive outputs of demultiplexer 322 are applied to shift register 315. Responsive to enabling signal $\overline{Q}$, shift register 317 shifts out the previously transposed group of 32 bits to transmitter 340 via OR gate 323 and line 324 at the C4 clock rate. Register 315 shifts under control of clock pulse C4. Since signal Q is disabling, shift register 315 is inhibited from sequentially shifting its contents to OR gate 323. In response to signal Q in its disabling state, demultiplexer 322 transfers the successive 32 bit group of waveform 501 into shift register 315 under control of the addressing code obtained from multiplier 333.

The R code from counter 329 is applied to one input of multiplier 333. The other input of multiplier 333 is supplied from $K_1$ key generator 331 via line 330. With counter 329 in its first stage and a 7 (00111) code being applied from generator 331, the 5-bit product code from multiplier 333 is 7 (00111). This address code causes the $b_1$ bit of waveform 501 to be inserted into the seventh position of shift register 315 as shown in waveform 503 of FIG. 5. When the $b_2$ bit is available from encoder 374, counter 329 is in state 00010 so that the product code from multiplier 333 is 14 (01110). Responsive to this product code, the $b_2$ bit of waveform 501 is transposed to the fourteenth position of shift register 315 as shown in waveform 503. As counter 329 is successively incremented, the bit group of waveform 501 is transposed into the scrambled bit group of waveform 503, so that the $i^{th}$ bit ($i=1,2,\ldots,N$) from encoder 374 is placed in the $K_1\,i^{th}$ (modulo N) position of register 315.

After the 32nd bit from encoder 374 is switched into shift register 315, counter 329 is reset to its 100001 state so that signal Q is enabled and signal Q is disabled. During the next 32 C4 clock pulses, the contents of shift register 315, shown in waveform 503, are serially shifted out and applied to transmitter 340 via gate 323 and line 324. Responsive to the enabled Q signal, the next 32-bit group from encoder 374 is applied in transposed order into shift register 317 via demultiplexer 322. In this manner, each successive 32-bit group corresponding to a portion of the outgoing speech signal from station 301 is scrambled and applied in scrambled order to transmitter 340. Transmitter 340 is operative to condition the scrambled bit stream obtained from encrypter 310 for transmission via outgoing line 312.

Decrypter 320 is operative to unscramble the scrambled bit stream applied thereto from incoming line 314 via receiver 360. Each 32-bit group of the bit stream, e.g., waveform 503, is applied to demultiplexer 365 which is operative to transpose the $j^{th}$ bit ($j=1,2,\ldots,N$) of the scrambled bit group to the $K_2 j^{th}$ bit position in the receiving shift register of registers 357 and 359 under control of the product code from multiplier 381. One input to multiplier 381 is obtained from the first five steps of counter 329. The other input to multiplier 381 is the 5-bit code from generator 371. In accordance with the invention, $K_2$ is chosen so that $K_2K_1=1$ (modulo N) to provide the inverse transformation of the scrambled bit group into replica of the original bit group. Where $K_1=7$, and $N=32$, $K_2=23$. The other station (not shown) in communication with station 301 must have an encrypting key $K_1=7$ and a decrypting key $K_2=23$. It is to be understood, however, that other key combinations may be used and that the key combinations for a pair of communicating stations need not be the same.

Assume, for purposes of illustration, that the scrambled 32-bit group shown in waveform 503 originating at the other station (not shown) is applied from incoming line 314 via receiver 350 to demultiplexer 365 and that shift register 357 has just been filled with the preceding 32-bit scrambled group from line 314. At this time, counter 329 is set to its 100001 state so that signal Q is enabling and signal $\bar{Q}$ is disabling. Responsive to signals Q and C4, the preceding scrambled bit group in register 357 is successively shifted out therefrom and applied to decoder 376 via OR gate 360. Shift register 359 is prevented from shifting by disabling signal $\bar{Q}$, and demultiplexer 365 is responsive to signal Q to address the 32 stages of shift register 359.

The outputs of the first five stages of counter 329 form coded signal R which is applied to multiplier 381 via line 385, and the output of code generator 371 is also applied to multiplier 381. With counter 329 in its first state, the product code on the output of multiplier 381 is 23 (10111). Jointly responsive to the Q signal and the 23 code from multiplier 381, demultiplexer 365 connects the output of receiver 350 to the 23rd stage of 32-stage shift register 359 via line 363-23. As shown in waveform 503, the first bit signal at the output of receiver 350 is the $b_{23}$ bit of the 32-bit group shown in waveform 503. This $b_{23}$ bit is transposed to the 23rd position of the group being formed in shift register 329. Thus, the $b_{23}$ bit of the scrambled message group is placed in its original position in the group being formed in register 329.

Responsive to the next C4 clock pulse, counter 329 is incremented to its 100010 state, the output of multiplier 381 becomes 46 modulo 32 (01110), and demultiplexer 365 connects the output of receiver 350 to the fourteenth stage of shift register 359 via line 363-14. In this way, bit $b_{14}$ is transposed from the second position in waveform 503 to the fourteenth position in shift register 359. In like manner, the succeeding bits of waveform 503 from receiver 350 are transposed into shift register 359 in accordance with the rule that the $j^{th}$ bit position in the sequence from receiver 350 ($j=1,2,\ldots,N$) is placed into the $K_2\,j^{th}$ stage of register 359. After the thirty-second bit from receiver 350 is placed into shift register 359, counter 329 is set to its 000001 state. During the next 32 C4 clock pulses, the contents of shift register 359 are successively applied to decoder 376 via OR gate 360 in the order shown in waveform 501. During this 32-clock pulse interval, the next successive scrambled bit group from receiver 350 is transposed into shift register 357.

The unscrambled 32-bit group sequence from shift register 359 (waveform 501) is decoded into a successive sample group by decoder 376, as is well known in the art. The successive samples from decoder 376 are supplied to low-pass filter 367, which is operative, as is well known in the art, to transform the successive samples into a replica of the originally transmitted signal. The original signal replica is then applied to station 301 via line 390. In this manner, the original speech signal is obtained from the scrambled incoming signal and is supplied station 301. The encryption and decryption circuits of FIG. 3 may comprise 74000 TTL circuits well known in the art.

Although the encryption and decryption circuits of FIG. 3 have been disclosed in the context of digital code encryption and decryption, it is readily seen that encrypter 310 may be operative to scramble successive samples of a station signal where encoder 374 is removed from the circuit so that the successive samples are applied directly to demultiplexer 322. Similarly, decrypter 320 may operate on a scrambled sampled signal by the removal of decoder 376. It is also apparent that encrypter 110 of FIG. 1 may be used for digital encryption, where an encoder circuit is inserted between sampling circuit 111 and shift registers 115 and 117. For digital encryption, digital shift registers replace analog registers 115 and 117, and a multiplexer replaces analog switch 122. In like manner, decrypter circuit 120 of FIG. 1 is readily converted to a digital decrypter by inserting a decoder circuit just before low-pass filter 167. Digital shift registers replace analog shift registers 157 and 159, and a multiplexer replaces analog switch 165.

While particular embodiments illustrative of the invention have been described, it is to be understood that various alterations and modifications may be made by those skilled in the art without departing from the spirit and scope of the invention. For example, while the particular embodiments utilize groups of 32 samples or bits, the invention may utilize larger groups to obtain greater privacy or smaller groups to obtain more economical circuit arrangements.

What is claimed is:

1. A privacy communication system comprising means for partitioning an intelligence signal into groups of N successive signal segments; means responsive to each group of signal segments for uniformly permuting the temporal sequence of the N successive segments to form a scrambled signal segment group comprising means for transposing the $i^{th}$ signal segment ($i = 1,2,\ldots N$) to the $K_1\,i^{th}$ (modulo N) segment position, where $K_1$ is an integer prime with respect to N; and means for reconstructing the group of N successive signal segments from the scrambled group comprising means for transposing the $j^{th}$ signal segment ($j = 1,2,\ldots,N$) of the scrambled segment group to the $K_2 j^{th}$ (modulo N) segment position, where $K_2K_1 = 1$ (modulo N).

2. A privacy communication system comprising means for sampling a speech signal at a predetermined rate, means for partitioning said speech signal samples into groups of N successive samples; means for uniformly permuting each group of N successive samples including first means for transposing the $i^{th}$ sample ($i = 1,2,\ldots,N$) of the successive sample group to the $K_1\,i^{th}$ (modulo N) sample position, where $K_1$ is an integer prime with respect to N, and means for reconstructing the group of N successive samples from said uniformly permuted group comprising second means for transposing the $j^{th}$ sample ($j = 1,2,\ldots,N$) of the uniformly permuted group to the $K_2 j^{th}$ (modulo N) sample position, where $K_2K_1 = 1$ (modulo N).

3. A privacy communication system according to claim 2 wherein said first transposing means comprises means for storing the group of N successive samples in successive order and means for rearranging said successively ordered stored samples to place the $K_1\,i^{th}$ (modulo N) stored sample in the $i^{th}$ position, and said second transposing means comprises means for storing the uniformly permuted group of N samples in successive order; and means for rearranging said permuted stored samples to place the $K_1\,i^{th}$ (modulo N) stored sample in the $j^{th}$ position.

4. A privacy communication system according to claim 2 wherein said first transposing means comprises first means for storing the $i^{th}$ sample of the N successive sample group in the $K_1 i^{th}$ (modulo N) position of said first storing means, and means for sequentially retrieving the stored samples from said first storing means in sequence ($i = 1,2, \ldots ,N$); and said second transposing means comprises second means for storing the $j^{th}$ sample of the uniformly permuted group of N samples in the $K_2 j^{th}$ (modulo N) position of said second storing means, and means for sequentially retrieving the stored samples from said second storing means in sequence ($j = 1,2, \ldots ,N$).

5. A privacy communication system comprising means for sampling an intelligence signal at a predetermined rate; means responsive to successively occurring samples for generating a multibit digital code representative of said intelligence signal samples to form a stream of code bits; means responsive to said code bit stream for partitioning said bit stream into group of N successive bits, first means responsive to each N successsive bit group for transposing the $i^{th}$ bit ($i = 1,2, \ldots ,N$) to the $K_1 i^{th}$ (modulo N) bit position to form a uniformly permuted bit group, where $K_1$ is an integer prime with respect to N; and means for reconstructing said N successive bit group from said uniformly permuted bit group including second means for transposing the $j^{th}$ bit ($j = 1,2, \ldots ,N$) of the uniformly permuted bit group to the $K_2 j^{th}$ (modulo N) position, where $K_2K_1 = 1$ (modulo N).

6. A privacy communication system according to claim 5 wherein said first transposing means comprises means for storing the group of N successive bits in successive order and means for recombining said stored successive ordered bits to place the $K_1 i^{th}$ (modulo N) bit in the $i^{th}$ position of the group; and said second transposing means comprises means for storing the uniformly permuted bit group in successive order and means for recombining said stored permuted ordered bits to place the $K_2 j^{th}$ (modulo N) bit in the $j^{th}$ position.

7. A privacy communication system according to claim 5 wherein said first transposing means comprises first means for storing the $i^{th}$ sample in the $K_1 i^{th}$ position of said first storing means and means for retrieving said stored bits in sequence from said first storing means in sequence ($= 1,2, \ldots ,N$); and said second transposing means comprises second means for storing the $j^{th}$ sample in the $K_2 j^{th}$ (modulo N) position of said second storing means and means for retrieving said stored bits from said second storing means in sequence ($j = 1,2, \ldots ,N$).

8. A privacy communication system comprising a communication network, a plurality of stations each having an outgoing line and an incoming line, an encrypting circuit connected to the outgoing line of each station, a decrypting circuit connected to the incoming line of each station, said encrypting circuit comprising means for receiving an outgoing signal from said station outgoing line, means for sampling said outgoing signal at a predetermined rate, means for partitioning said outgoing signal samples into groups of N successive samples, first means for transposing the $i^{th}$ sample ($i = 1,2, \ldots ,N$) of said N successive sample group to the $K_1 i^{th}$ (modulo N) sample position to form a uniformly permuted group, where $K_1$ is an integer prime with respect to N, and said decrypting circuit comprises means for receiving successive groups of N permuted samples from said communication network, means for reconstructing a group of N successive samples from said permuted group including second means for transposing the $j^{th}$ sample ($j = 1,2, \ldots ,N$) of said uniformly permuted group to the $K_2 j^{th}$ (modulo N) sample position to form a group of N successive samples, where $K_2K_1 = 1$ (modulo N), means responsive to said reconstructed group for forming an analog signal, and means for applying said analog signal to said station incoming line.

9. A privacy communication system according to claim 8 wherein said first transposing means comprises first means for storing said N successive samples in successive order, and means for retrieving the samples from said first storing means in the $K_1 i^{th}$ (modulo N) order ($i = 1,2, \ldots ,N$); and said second transposing means comprising second means for storing the uniformly permuted group of N samples in successive order and means for retrieving the stored samples from said second storing means in the $K_2 j^{th}$ (modulo N) order ($j = 1,2, \ldots ,N$).

10. A privacy communication system according to claim 8 wherein said first transposing means comprises first means for storing the $i^{th}$ sample of the N successive sample group in the $K_1 i^{th}$ (modulo N) position ($i = 1,2, \ldots ,N$) of said first storing means, and means for retrieving the stored samples from said first storing means in successive sequence; and said second transposing means comprises second means for storing the $j^{th}$ sample of the uniformly permuted group of N samples in the $K_2 j^{th}$ (modulo N) position ($j = 1,2, \ldots ,N$) of said second storing means, and means for retrieving the stored samples from said second storing means in successive sequence.

11. A privacy communication system comprising a communication network; a plurality of stations each having an outgoing line and an incoming line; an encrypting circuit connected to the outgoing line of each station, a decrypting circuit connected to the incoming line of each station; said encrypting circuit comprising means for receiving an outgoing signal from said station outgoing line; means for sampling said outgoing signal at a predetermined rate; means responsive to said outgoing signal samples for generating a coded multibit stream corresponding to said outgoing signal; means responsive to said multibit stream for partitioning said bits into groups of N successive bits, and first means for transposing the $i^{th}$ bit ($i = 1,2, \ldots ,N$) of said N successive bit group to the $K_1 i^{th}$ (modulo N) bit position to form a uniformly permuted group, where $K_1$ is an integer prime with respect to N; and said decrypting circuit comprises means for receiving successive groups of N permuted bits from said communication network; means for reconstructing a group of N successive bits from said uniformly permuted group including second means for transposing the $j^{th}$ bit ($j = 1,2, \ldots ,N$) of said uniformly permuted group to the $K_2 j^{th}$ (modulo N) bit position to form a group of N successive bits, where $K_2K_1 = 1$ (modulo N); means responsive to said reconstructed group for forming a replica of the samples of said received permuted bits; means responsive to said sample replicas for forming an analog signal; and means for applying an analog signal to said station incoming line.

12. A privacy communication system according to claim 11 wherein said first transposing means comprises first means for storing said N successive bits in successive order and means for retrieving the stored set from said first storing means in the $K_1 i^{th}$ (modulo N) order ($i = 1,2, \ldots ,N$), and said second transposing means comprises second means for storing the uniformly permuted group bits in successive order and means for retrieving the stored bits from said second storing means in the $K_2$ $j^{th}$ (modulo N) order ($j = 1,2, \ldots ,N$).

13. A privacy communication system according to claim 11 wherein said first transposing means comprises first means for storing the $i^{th}$ bit of the N successive bit group in the $K_1$ $i^{th}$ (modulo N) position ($i = 1,2, \ldots ,N$) of said first storing means and means for retrieving the stored samples from said first storing means in successive sequence, and said second transposing means comprises second means for storing the $j^{th}$ bit of the uniformly permuted group of N bits in the $K_2$ $j^{th}$ (modulo N) position ($j = 1,2, \ldots ,N$) of said second storing means and means for retrieving the stored samples from said second storing means in successive sequence.

14. A privacy communication method comprising the steps of partitioning an intelligence signal into groups of N successive signal segments, uniformly permuting the temporal sequence of the N successive elements to form a scrambled signal segment group by transposing the $i^{th}$ signal segment ($i = 1,2, \ldots ,N$) to the $K_1$ $i^{th}$ (modulo N) segment position, where $K_1$ is an integer prime with respect to N, and reconstructing the group of N successive signal segments from said scrambled group by transposing the $j^{th}$ segment ($j = 1,2, \ldots ,N$) of the scrambled segment group to the $K_2$ $j^{th}$ (modulo N) segment position, where $K_2K_1 = 1$ (modulo N).

15. A privacy communication method comprising the steps of sampling an intelligence signal at a predetermined rate, partitioning said intelligence signal samples into groups of N successive samples; uniformly permuting each group of N successive samples by transposing the $i^{th}$ sample ($i = 1,2, \ldots ,N$) to the $K_1$ $i^{th}$ (modulo N) sample position, where $K_1$ is an integer prime with respect to N; and means for reconstructing the group of N successive samples from said uniformly permuted group by transposing the $j^{th}$ sample ($j = 1,2, \ldots ,N$) of the uniformly permuted group to the $K_2$ $j^{th}$ (modulo N) sample position, where $K_2K_1 = 1$ (modulo N).

16. A privacy communication method comprising the steps of sampling an intelligence signal at a predetermined rate, generating a multibit digital code representative of said intelligence signal from said samples to form a stream of code bits, partitioning said stream of code bits into groups of N successive bits, transposing the $i^{th}$ bit ($i = 1,2, \ldots ,N$) to the $K_1$ $i^{th}$ (modulo N) bit position to form a uniformly permuted N bit group, where $K_1$ is an integer prime with respect to N, and reconstructing said N successive bit group from said uniformly permuted group by transposing the $j^{th}$ bit ($j = 1,2, \ldots ,N$) of the uniformly permuted group to the $K_2$ $j^{th}$ (modulo N) bit position, where $K_2K_1 = 1$ (modulo N).

* * * * *